US010611156B2

(12) United States Patent
Taira et al.

(10) Patent No.: US 10,611,156 B2
(45) Date of Patent: Apr. 7, 2020

(54) INKJET RECORDING APPARATUS

(71) Applicant: CANON KABUSHIKI KAISHA, Tokyo (JP)

(72) Inventors: Hiroshi Taira, Fuchu (JP); Toshimitsu Danzuka, Tokyo (JP); Taku Yokozawa, Yokohama (JP); Noboru Kunimine, Tokyo (JP); Akiko Aichi, Tokyo (JP); Kazuki Narumi, Komae (JP); Tomoki Yamamuro, Kawasaki (JP); Kazuhiko Sato, Tokyo (JP); Kazuo Suzuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/011,497

(22) Filed: Jun. 18, 2018

(65) Prior Publication Data

US 2018/0370239 A1 Dec. 27, 2018

(30) Foreign Application Priority Data

Jun. 23, 2017 (JP) ..... 2017-123451

(51) Int. Cl.
*B41J 2/165* (2006.01)

(52) U.S. Cl.
CPC ..... *B41J 2/16535* (2013.01); *B41J 2/16517* (2013.01); *B41J 2/16523* (2013.01); *B41J 2/16538* (2013.01); *B41J 2/16544* (2013.01); *B41J 2002/16573* (2013.01)

(58) Field of Classification Search
CPC ..... B41J 2/16517; B41J 2/16535; B41J 2002/16573
See application file for complete search history.

(56) References Cited

U.S. PATENT DOCUMENTS

| | | | | |
|---|---|---|---|---|
| 6,283,574 | B1 | 9/2001 | Sugimoto | |
| 2002/0126308 | A1* | 9/2002 | Uetsuki | B41J 2/16517 358/1.14 |
| 2009/0046123 | A1* | 2/2009 | Muraoka | B41J 2/16538 347/33 |
| 2010/0302297 | A1* | 12/2010 | Suzuki | B41J 2/16526 347/14 |

* cited by examiner

*Primary Examiner* — Alessandro V Amari
*Assistant Examiner* — Kendrick X Liu
(74) *Attorney, Agent, or Firm* — CANON U.S.A., INC. IP Division

(57) ABSTRACT

An inkjet recording apparatus according to the present disclosure executes a first wiping operation in a case where the count value counted by the count unit is higher than a first threshold value while the recording operation is being performed and execute a second wiping operation when the recording operation completes in a case where the count value counted by the count unit is higher than a second threshold value. The inkjet recording apparatus also executes the second wiping operation when the first wiping operation has been performed while the recording operation is being performed.

13 Claims, 10 Drawing Sheets

FIG. 10

| NUMBER OF DISCHARGES PER UNIT TIME PERIOD | FIRST CORRECTION COEFFICIENT | SECOND CORRECTION COEFFICIENT |
|---|---|---|
| $0 < N < 38,400$ | 0.2 | 0.3 |
| $38,400 \leq N < 76,800$ | 0.4 | 0.6 |
| $76,800 \leq N < 115,200$ | 0.6 | 0.9 |
| $115,200 \leq N < 153,600$ | 0.8 | 1.0 |
| $153,600 \leq N$ | 1.0 | 1.0 |

INKJET RECORDING APPARATUS

BACKGROUND

Field of the Disclosure

The present disclosure relates to an inkjet recording apparatus.

Description of the Related Art

U.S. Pat. No. 6,283,574 discloses an inkjet recording apparatus, wherein a dot counter counts recording dots so that an ink discharge surface (discharge opening surface) of a record head can be wiped while or after recording (or after discharging recording paper) based on a result of the counting.

An inkjet recording apparatus configured to record an image on a recording medium having a large-format size (such as A0 or A1 size) may consume a large amount of ink for performing a recording operation. Such an inkjet recording apparatus may perform wiping a plurality of number of times to keep a satisfactory state of a discharge opening surface of a record head thereof. However, execution of a plurality of number of times of wiping in the middle of a recording operation may reduce the throughput of the recording apparatus. On the other hand, execution of the wiping after the recording operation completes instead of wiping in the middle of the recording operation may cause defective discharge due to ink clogging during the recording operation, possibly lowering the resulting image quality.

Therefore, it is desirable to provide an inkjet recording apparatus which can suppress reduction of its throughput and which, at the same time, can keep a satisfactory state of a discharge opening surface of a record head thereof.

SUMMARY

An inkjet recording apparatus according to an aspect of the present disclosure includes a record head having a discharge opening surface having discharge openings for discharging ink, the record head being configured to perform a recording operation, a wiping unit configured to perform a wiping operation for wiping the discharge opening surface, a count unit configured to count dots of ink discharged from the record head after a previous wiping operation is performed, and a control unit configured to execute a first wiping operation in a case where the count value counted by the count unit is higher than a first threshold value while the recording operation is being performed and execute a second wiping operation when the recording operation completes in a case where the count value counted by the count unit is higher than a second threshold value. The control unit also executes the second wiping operation when the first wiping operation has been performed while the recording operation is being performed.

Further features of the present invention will become apparent from the following description of exemplary embodiments with reference to the attached drawings.

BRIEF DESCRIPTION OF THE DRAWINGS

FIG. 10 illustrates correction coefficients for numbers of discharges per unit time period according to the third embodiment.

DESCRIPTION OF THE EMBODIMENTS

First Embodiment

An inkjet recording apparatus according to a first embodiment of the present disclosure will be described in detail with reference to drawings.

Figure 1:
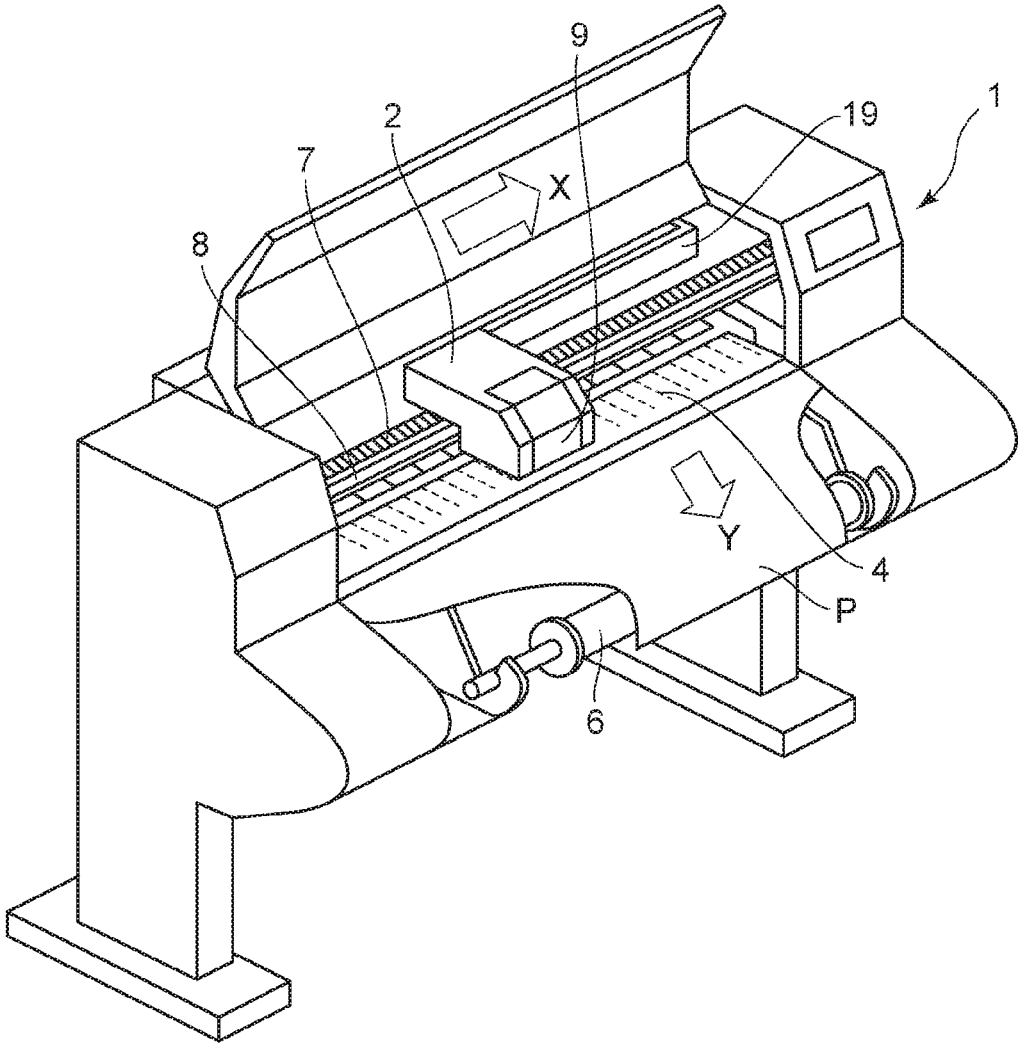
FIG. 1 is a perspective view of an inkjet recording apparatus according to a first embodiment.

FIG. 1 is a perspective view of an inkjet recording apparatus (hereinafter, also simply called a recording apparatus) according to this embodiment. A recording apparatus 1 includes a feeding portion configured to feed a recording medium, a conveying portion configured to convey the recording medium, a recording portion configured to record an image on the recording medium, a discharge portion configured to discharge the recording medium having an image recorded thereon, and a recovery portion configured to recover recording performance of the recording portion.

The feeding portion has a roll sheet holder (spool) 6 configured to rotatably hold a roll-shaped recording medium (roll sheet) P. The roll sheet holder 6 is configured to be driven by a feed motor, not illustrated, to rotate and feed the recording medium P to an internal part of the recording apparatus.

The conveying portion has a conveyance roller configured to convey the recording medium P fed from the feeding portion and a pinching roller facing the conveyance roller so that the pinching roller and the conveyance roller can pinch the recording medium P. The recording medium P fed from the feeding portion and pinched by the conveyance roller and the pinching roller is conveyed to the recording portion.

The recording portion has a record head 9 having a discharge opening surface (nozzle surface) having discharge openings (nozzles) configured to discharge ink and a carriage 2 to which the record head 9 is detachably attached.

The carriage 2 is configured to be driven by a carriage motor (CR motor) 114 to be capable of reciprocally moving in an X direction (or a direction of movement of the carriage) along a guide shaft 8. The driving force may be transmitted from the carriage motor 114 to the carriage 2 through a carriage belt, for example. The recording medium P is conveyed in a Y direction (or a direction of conveyance of the recording medium) intersecting with the X direction. The recording medium P to be conveyed is supported at its lower part by a platen 4.

The record head 9 is configured to discharge ink to the recording medium staying at a position facing the record head 9 while the carriage 2 is moving in the X direction. The timing for ink discharging can be determined based on a position signal of the carriage 2 which is obtained by an encoder 7. The discharging operation records an image for one band (or for one line feed) on the recording medium. According to this embodiment, the carriage 2 moves at a movement speed of 40 inches per second (inch/sec), and the discharging operation is performed at a resolution of 600 dpi (600 dot/inch). After the discharging operation, the conveyance roller is driven by a predetermined amount by a conveyance motor (LF motor) 113 so that the recording medium P is conveyed by the predetermined amount in the Y direction. The discharging operation with the record head 9 and the conveyance (intermittent conveyance) by the predetermined amount with the conveyance roller are repeated alternately so that an image for one page is recorded on the recording medium P.

A flexible wiring substrate 19 is attached to the record head 9 and is configured to supply driving pulses for driving discharging and a signal for head temperature adjustment. The flexible wiring substrate 19 has the other end connected to a control unit having a control circuit such as a CPU configured to execute a control over the recording apparatus.

The discharge portion has a discharge opening configured to discharge a recording medium having an image recorded thereon. The recording medium P having an image for one page recorded thereon is cut at a rear end of the image by a cutter, not illustrated, to one recorded material which is then discharged to outside of the apparatus through the discharge opening.

Figure 2:
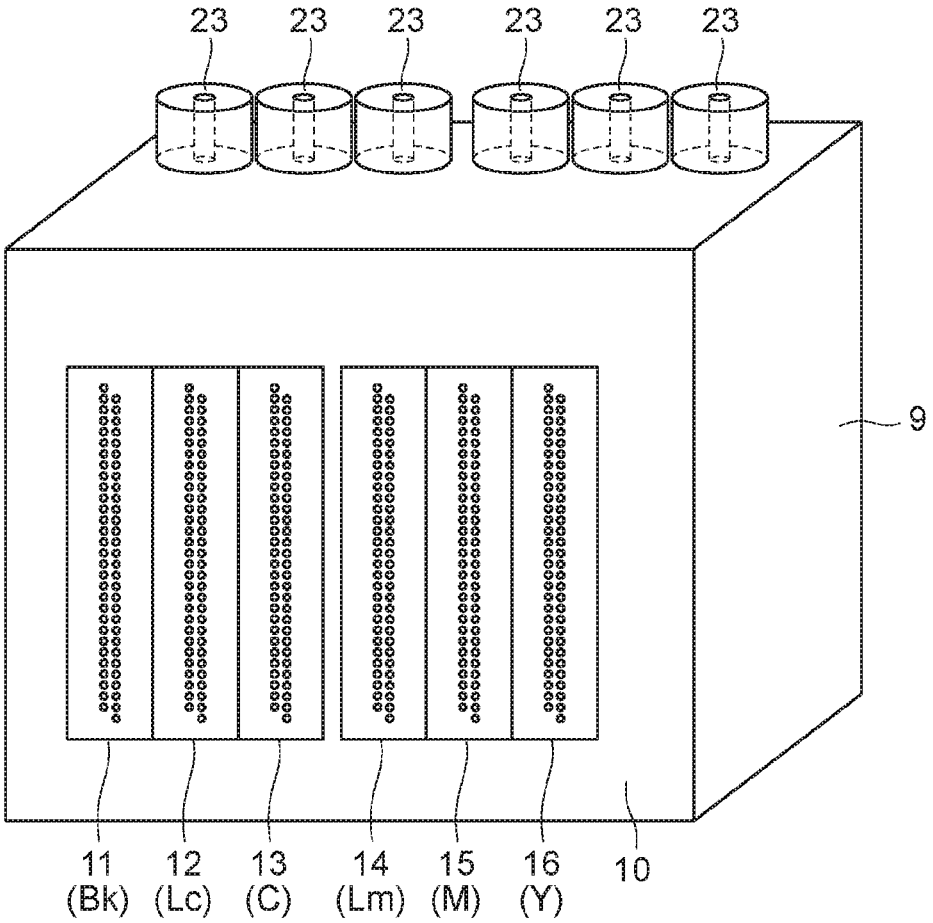
FIG. 2 is a schematic diagram illustrating a record head according to the first embodiment.

Next, a configuration of the record head according to this embodiment will be described in detail. FIG. 2 is a schematic diagram illustrating the record head according to this embodiment. FIG. 2 illustrates the record head 9 viewed from a direction of ink discharge (bottom view). The record head has a discharge opening surface (nozzle surface) 10 having a plurality of discharge opening arrays (nozzle arrays) 11 to 16 each having a plurality of discharge openings (nozzles) configured to discharge ink. The discharge opening arrays 11 to 16 are arranged to be capable of discharging inks of different color tones (including colors and densities) along the carriage movement direction. For example, the discharge opening arrays 11 to 16 may be arranged to be capable of discharging inks of black (Bk), light cyan (Lc), cyan (C), light magenta (Lm), magenta (M) and yellow (Y) in the carriage movement direction. Ink introducing units 23 are connected to the discharge openings through ink tanks (not illustrated) and tubes. Each of the discharge openings receives ink from the corresponding ink introducing unit 23 through an ink channel within the record head.

Figure 3:
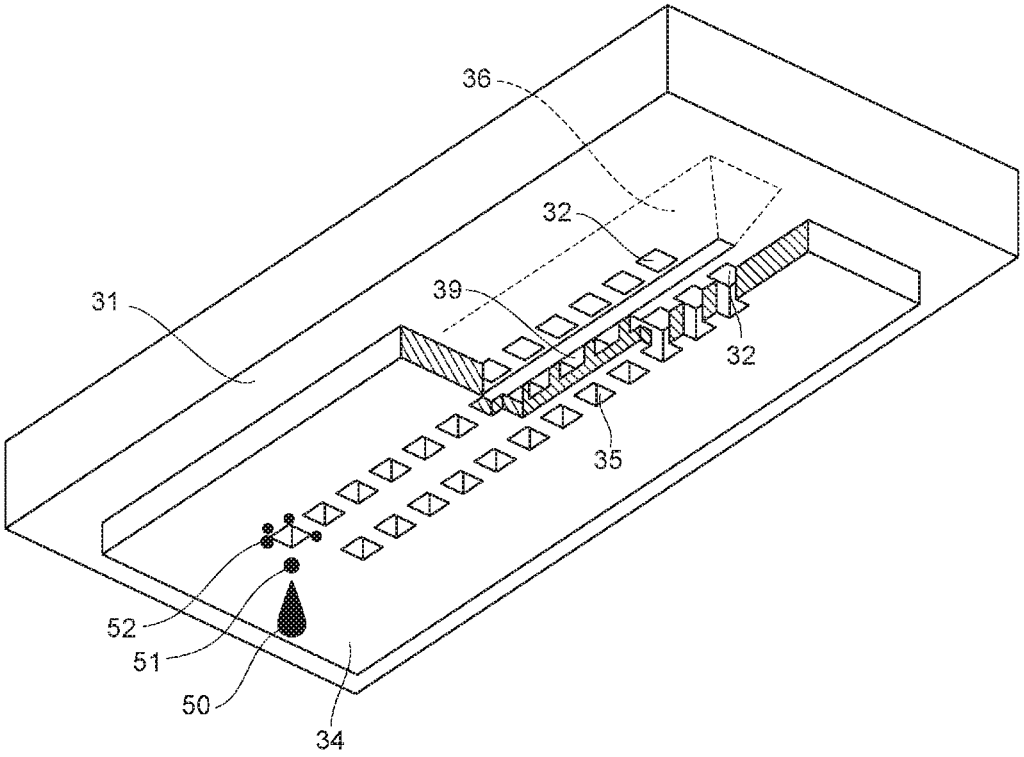
FIG. 3 is a schematic diagram illustrating a discharge opening surface of the record head according to the first embodiment.

FIG. 3 is a schematic diagram illustrating the discharge opening surface of the record head according to this embodiment. The record head 9 according to this embodiment employs energy for discharging ink such as thermal energy causing film boiling in ink in response to an energization according to a so-called bubble jet (registered trademark) method. The record head 9 has a substrate 31 having two parallel arrays of heating units 32 arranged at predetermined pitches. An ink supply port 36 communicating to the ink channel is provided between the heating unit arrays on the substrate 31. A member (orifice plate) 34 having nozzles 35 and ink paths 39 is adjoined to the substrate 31. The nozzles 35 are provided correspondingly to the heating units 32. The ink paths 39 are also provided correspondingly to the nozzles 35 and are configured to supply ink through the ink supply port 36. In each of the arrays, the heating units 32 and the nozzles 35 are displaced from each other by a half pitch to provide a desired record resolution. According to this embodiment, the discharge opening arrays 11 to 16 have 1280 nozzles at a density of about 490 nozzles for 1 cm for each color.

During a recording operation, ink droplets 50 are discharged from the nozzles 35 of each of the nozzle arrays. It is known that ink mist (or mist) 51 is caused by the discharging in this case. The mist 51 may partially be adhered to the discharge opening surface of the record head 9 due to an airflow occurring in the recording apparatus, for example, so that the discharge opening surface may have mist staining (ink adherent) 52 thereon.

Figure 4:
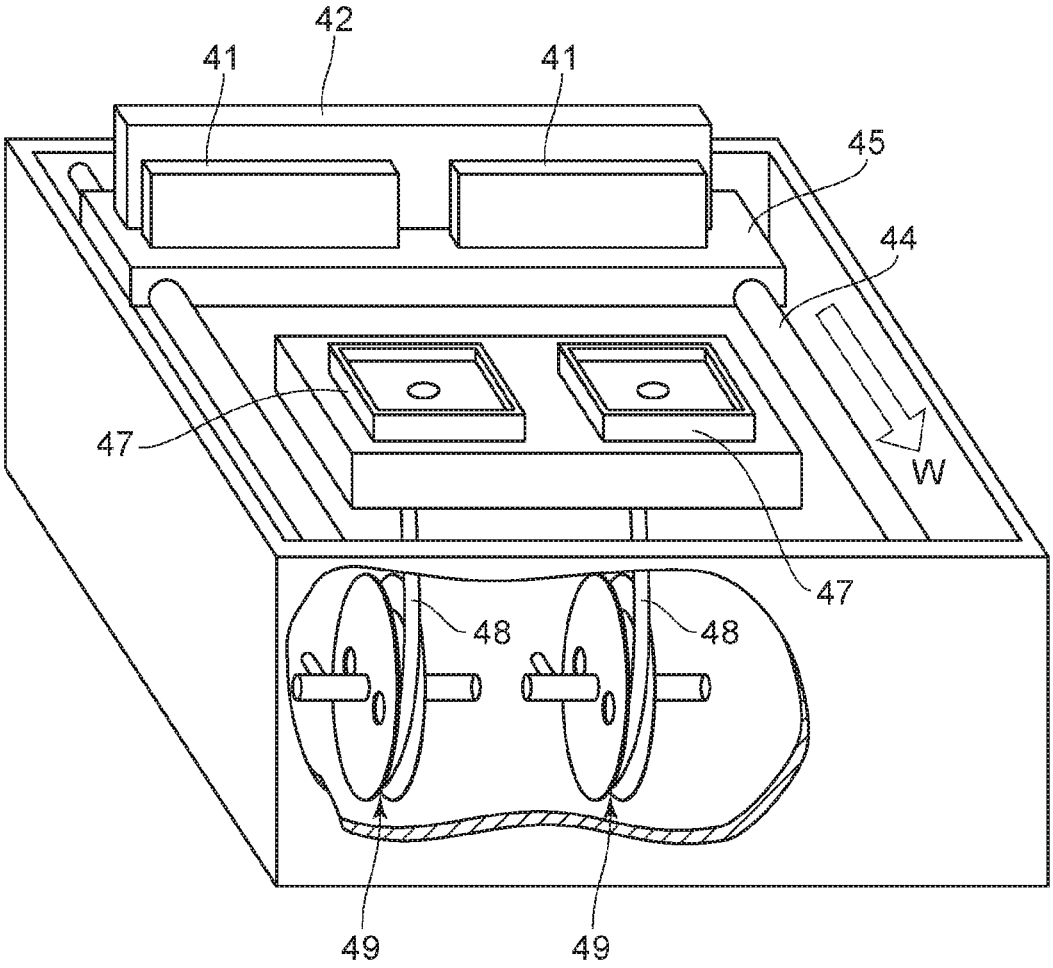
FIG. 4 is a schematic diagram illustrating a recovery unit according to the first embodiment.

Next, the recovery portion according to this embodiment will be described in detail. FIG. 4 is a schematic diagram illustrating the recovery unit according to this embodiment. The recovery portion includes a recovery unit having caps 47, suction pumps 49 and wipers 41 and 42. The caps 47 are configured to cover the discharge opening surface of the record head. The suction pumps 49 are configured to suck ink from the record head when the caps cover the discharge opening surface. The wipers 41 and 42 are configured to wipe the discharge opening surface of the record head. The recovery unit is placed in an area outside a record region in the carriage movement direction. The carriage 2 stops at a home position outside the record region as required before a recording operation starts or while a recording operation is being performed. The recovery unit is placed at a position facing the record head 9 when the carriage 2 stops at the home position.

Each of the caps 47 is supported vertically movably by a raise/lower mechanism, not illustrated, and can move between a rise position and a fall position. The caps 47 at the rise position abut against the record head 9 and cover (or cap) the discharge opening surface of the record head. The caps 47 covering the discharge opening surface of the record head can prevent evaporation of ink due to dried discharge openings of the record head while no record operation is being performed. Alternatively, the suction pumps 49, which will be described below, may be driven to suck ink from the record head. While a recording operation is being performed, the caps 47 position at the fall position to avoid interference with the record head 9 which follows movement of the carriage 2. With the caps 47 positioned at the fall position, the record head 9 can perform an auxiliary discharge to the caps 47 when the record head 9 moves to the position facing the caps 47.

The wipers (wiper blades) 41 and 42 may be configured by an elastic member such as rubber. According to this embodiment, two wipers 41 and one wiper 42 are provided. Referring to FIG. 2, each of the two wipers 41 is configured to wipe three discharge opening arrays (11 to 13 and 14 to 16). The wiper 42 is configured to wipe the whole discharge opening surface including the discharge opening arrays 11 to 16. The wipers 41 and 42 are fixed to a wiper holder 45. The wiper holder 45 is movable in a back-and-forth direction indicated by an arrow W along a guide 44 (or the direction of the arrangement of the discharge openings of the record head). When the record head 9 is at the home position, the wiper holder 45 may move in the arrow W direction (one way) so that the wipers 41 and 42 abutted against the discharge opening surface can perform a wiping operation for wiping the discharge opening surface. When the wiping operation completes, the carriage 2 is moved and is retracted from a region for the wiping operation. Then, the wiper holder 45 is moved to return the wipers 41 and 42 to their original positions (where the wipers 41 and 42 originally stay before the wiping operation).

Although the wipers according to this embodiment may be configured by an elastic member, the wipers may be configured by a porous material that absorbs ink. Although the wiping is performed only when the wipers move only one way according to this embodiment, the wiping may be performed when the wipers move in going and returning directions. Although the wiping is performed in the direction of alignment of the discharge openings in the record head according to this embodiment, the wiping may be performed in a direction intersecting with (orthogonal to) the direction (or the direction of arrangement of the discharge opening arrays).

The suction pumps 49 are driven when the caps 47 cover the discharge opening surface of the record head to substantially tightly close the inside. Because of a negative pressure state of the inside, the suction pumps 49 can perform a suction operation for sucking ink from the record head. The suction operation may be performed to fill ink into the record head from an ink tank (for initial filling) and to suck and remove dust, sticking matters, and bubbles, for example, within the discharge openings (for suction recovery). The caps 47 are connected to a waste-ink absorber, not illustrated, through flexible tubes 48.

According to this embodiment, the suction pumps 49 are tube pumps. Each of the tube pumps has a holding unit, a roller, and a roller supporting unit. The holding unit has a curved surface which holds the tube 48 along the curved surface (at least partially). The roller can press the held tube 48. The roller supporting unit rotatably supports the roller. Each of the tube pumps rotates the roller supporting unit in a predetermined direction to flatten and rotate the tube 48. Thus, negative pressure is generated within the caps 47 to suck ink from the record head. The sucked ink is discharged to the waste-ink absorber through the tubes 48. After the record head 9 performs an auxiliary discharge toward the caps 47, a suction operation is also performed to discharge ink received by the caps 47 through the auxiliary discharge. In other words, the suction pumps 49 are driven when a predetermined amount of ink is held within the cap 47 after an auxiliary discharge is performed. Thus, ink held within the caps 47 can be discharged to the waste-ink absorber through the tubes 48.

Figure 5:
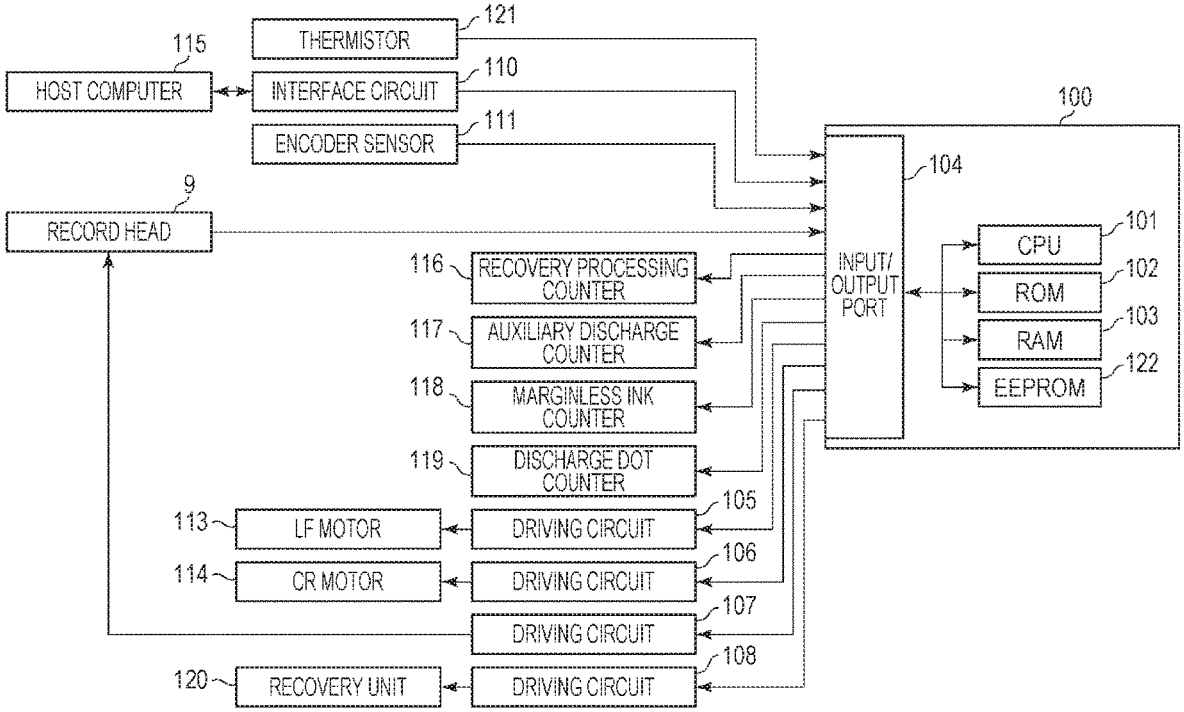
FIG. 5 is a block diagram illustrating a control configuration according to the first embodiment.

Next, a control configuration of the recording apparatus according to this embodiment will be described. FIG. 5 is a block diagram illustrating a control configuration according to this embodiment. A main control unit 100 includes a CPU 101 configured to execute processing operations including calculating, controlling, discriminating, and defining. The main control unit 100 further includes a ROM 102 configured to store a control program to be executed by the CPU 101. The main control unit 100 further includes a RAM 103 usable as a buffer configured to store binary record data indicating ink discharge/non-discharge and as a work area for processing performed by the CPU 101. The RAM 103 can also be used as a storage unit configured to store amounts of ink within the ink tank before and after a recording operation.

The main control unit 100 further includes an input/output port 104. Driving circuits 105, 106, 107, and 108 for the conveyance motor (LF motor) 113, the carriage motor (CR motor) 114, the record head 9, and the recovery unit 120 are connected to the input/output port 104. The driving circuits 105, 106, 107, and 108 are controlled by the main control unit 100. Sensors such as an encoder sensor 111 provided within the carriage 2 and a thermistor 121 configured to detect an environment temperature and an environment humidity within the recording apparatus are further connected to the input/output port 104. The input/output port 104 is connected to a host computer 115 through an interface circuit 110. The head driving circuit 107 which functions as a unit configured to transmit a signal to the record head transmits record data for recording as well as driving pulses to apply. The record data and driving pulses are transferred through the flexible wiring substrate 19.

A recovery processing counter 116, an auxiliary discharge counter 117, a marginless ink counter 118, and a discharge dot counter 119 are also connected to the input/output port 104. The recovery processing counter 116 is configured to count dots of ink forced to be discharged from the record head 9 by the recovery unit 120. The auxiliary discharge counter 117 is configured to count dots of auxiliarily discharged ink, which does not contribute to image recording before a recording operation starts or after a recording operation completes. The marginless ink counter 118 is configured to count dots of ink discharged to outside of a region corresponding to a recording medium when a marginless recording operation is performed. The discharge dot counter 119 is configured to count dots of ink discharged to a recording medium by a recording operation.

An EEPROM 122 is configured to store information regarding the ink dots counted by the counters 116 to 119 and information regarding a cumulative value, which is calculated based on the ink dot counts, of the counts of dots of ink discharged from the record head 9 after a previous wiping operation is performed. The EEPROM 122 can also store other various kinds of information in addition to the information regarding the ink dot counts.

Figure 6:
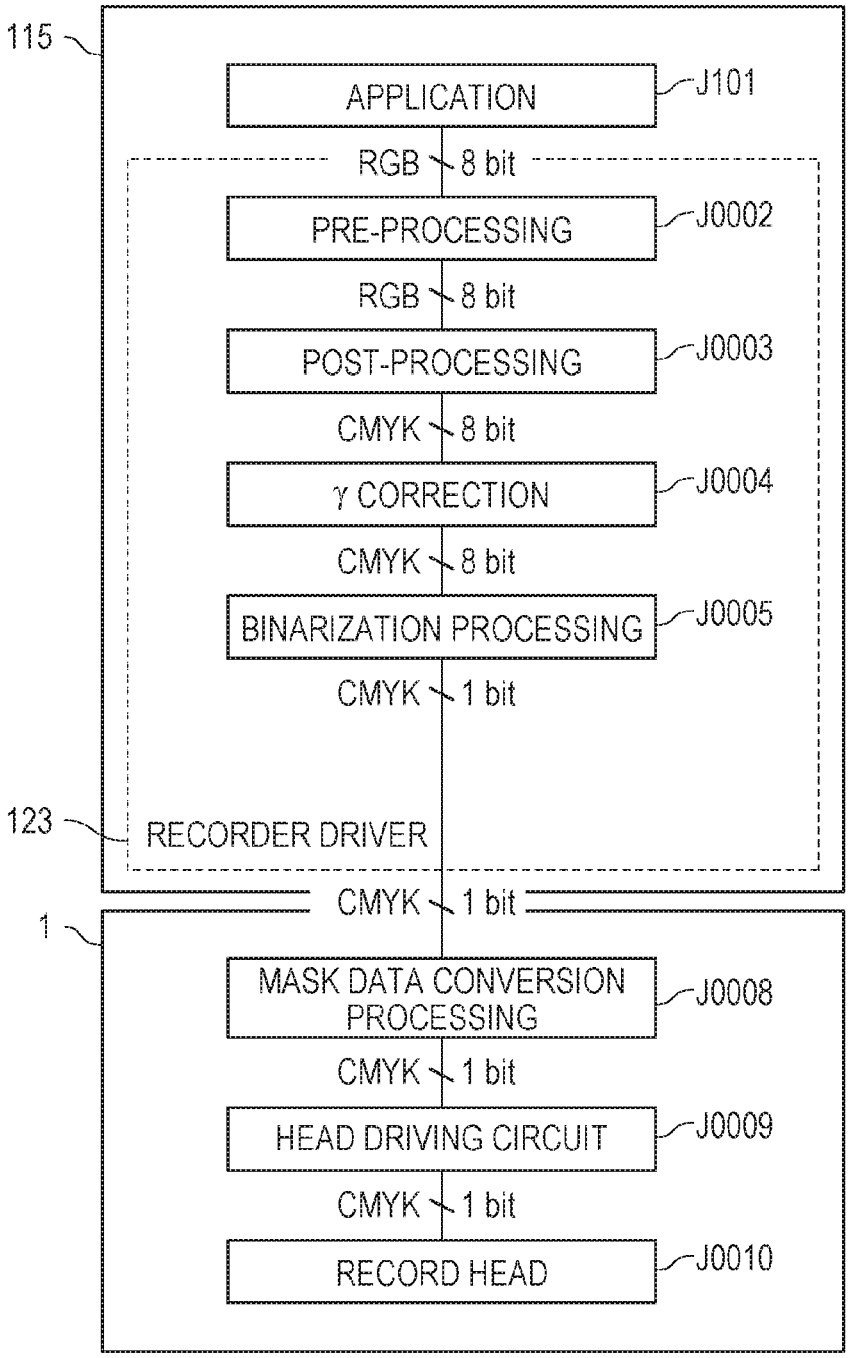
FIG. 6 is a flowchart illustrating processing to be performed on image data according to the first embodiment.

FIG. 6 is a flowchart illustrating processing to be performed on image data according to this embodiment. Image data to be recorded by the recording apparatus 1 is generated through an application J101 in the host computer 115. For performing a recording operation, the image data generated by the application J101 is transmitted to a recorder driver 123. The recorder driver 123 executes pre-processing J0002, post-processing J0003, γ correction J0004, and binarization processing J0005 on the generated image data.

The pre-processing J0002 performs a gamut conversion which converts a gamut of a display unit defined in the host computer 115 to a gamut of the recording apparatus. A three-dimensional lookup table can be used to convert data pieces R, G, and B of an image having R, G, and B each represented by eight bits to 8-bit data pieces R, G, and B within the gamut of the recording apparatus.

The post-processing J0003 decomposes the colors which reproduce the converted gamut to the gamut of inks. The post-processing J0003 performs processing for acquiring 8-bit data pieces corresponding to a combination of inks for reproducing colors indicated by the 8-bit data pieces R, G, and B within the gamut of the recording apparatus, which are acquired by the pre-processing J0002.

The γ correction J0004 performs a γ correction on the 8-bit data pieces acquired by the color separation. The conversion includes linear association of the 8-bit data pieces acquired by the post-processing J0003 with gradation characteristics of the recording apparatus.

The binarization processing J0005 performs a quantization process which converts the 8-bit data pieces acquired by the γ correction J0004 to 1-bit data pieces to generated binary data. For quantization therefor, a density pattern method, a dither method, an error diffusion method or the like can be used.

The thus generated data are transmitted to the recording apparatus 1. Mask data conversion processing J0008 converts the binary data generated by the binarization processing J0005 and data regarding a mask pattern stored in the ROM 102 to record data indicating discharge and non-discharge of ink. The mask pattern contains a specific arrangement pattern of record-permitted pixels for which discharge of ink is permitted and record non-record-permitted pixels for which discharge of ink is not permitted.

The mask pattern to be used for the mask data conversion processing J0008 is pre-stored in a predetermined memory within the recording apparatus. For example, the mask pattern can be pre-stored in the ROM 102, and the mask pattern can be used by the CPU 101 for the conversion to record data. Different mask patterns can be used in accordance with a record mode.

The record data acquired by the mask data conversion processing J0008 is transmitted to the head driving circuit 107 and the record head 9 (J0009 and J0010). Based on the record data, ink are discharged to a recording medium P through discharge openings arranged in the record head 9. At that time, the discharge dot counter 119 counts dots of ink discharged by the recording operation, and information regarding a cumulative value of the counts of ink discharged from the record head 9 after a previous wiping operation is performed is stored in the EEPROM 122.

The recording apparatus according to this embodiment performs a recording operation by controlling driving of the motors and the record head based on the record data generated by those kinds of processing.

Figure 7:
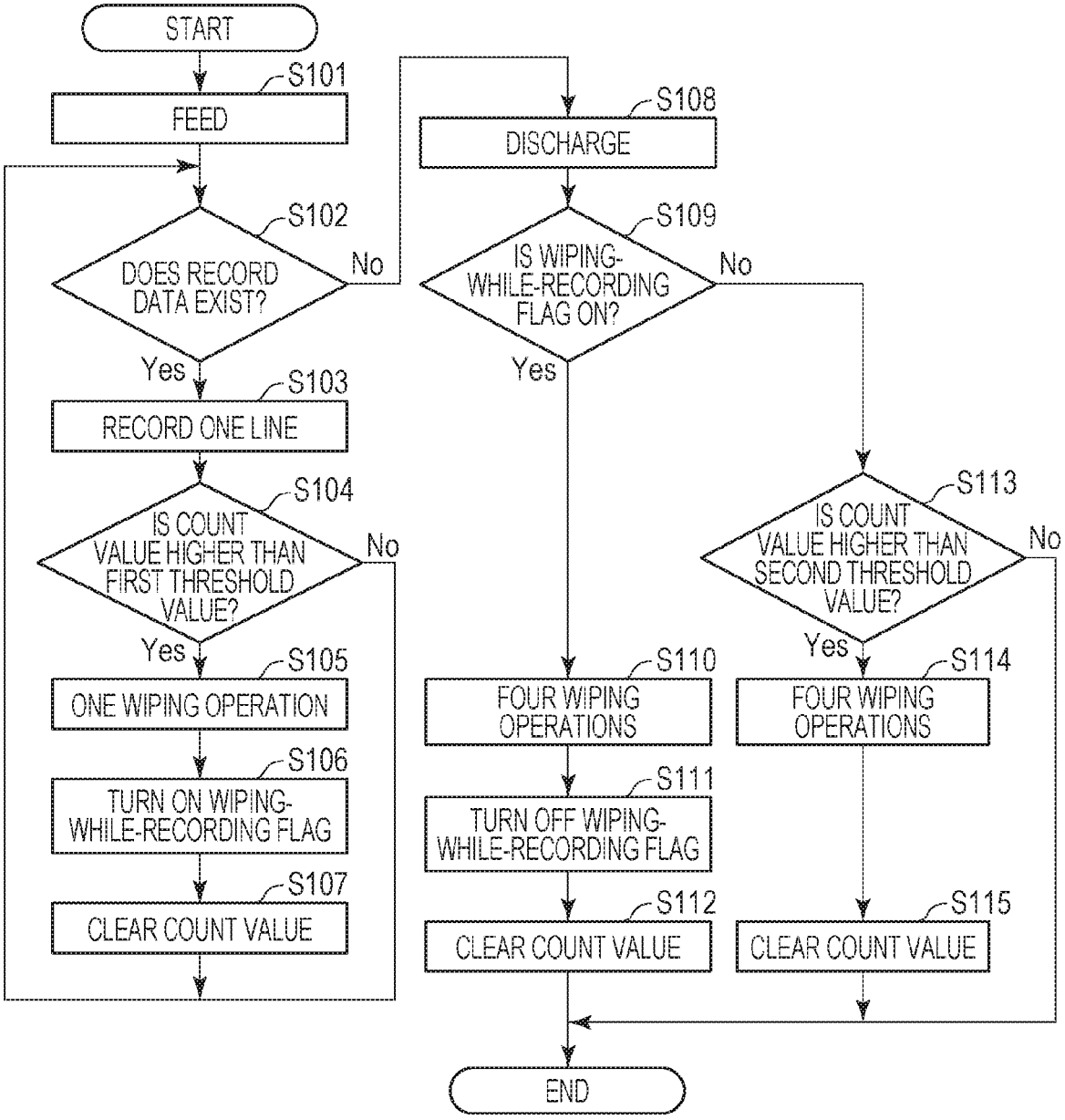
FIG. 7 is a flowchart illustrating control steps to be performed on a recovery operation according to the first embodiment.

Next, control steps, which is a characteristic of the present disclosure, to be performed for a recovery operation (wiping operation) for keeping a satisfactory discharging performance of the record head will be described. FIG. 7 is a flowchart illustrating control steps for the recovery operation according to this embodiment.

In step S101, in response to a record command, a recording medium P is fed and is conveyed to a position (record start position) where recording with the record head is started. Next in step S102, whether record data generated by the conversion processing exists or not is determined. If the record data exists, the processing moves to step S103 where a recording operation for one line (one line feed or one band) is performed. Here, the number of dots of ink discharged from the record head in the recording operation is counted as a dot count value. More specifically, the number of times of driving for a recording element is counted, and the count value is stored in the EEPROM 122. The count value is cleared (or reset to 0) after a wiping operation is performed, which will be described below. In other words, the count value represents an amount of ink discharged from the record head after a previous wiping operation is performed.

Next in step S104, the count value is compared with a first threshold value. According to this embodiment, the first threshold value is $2\times10^9$. If the count value is higher than the first threshold value, the processing moves to step S105 where a wiping operation is executed for wiping the discharge opening surface of the record head. The wiping operation is performed by, as described above, moving the carriage 2 to a position facing the recovery unit and moving the wiper holder 45 holding the wipers 41 and 42 in a single direction (one way). The wiping operation performs wiping only once (first wiping operation). Next, in step S106, a flag (wiping-while-recording flag) is set to an ON state which indicates that the wiping operation (first wiping operation) has been executed while a recording operation is being performed. In step S107, the count value is cleared (or reset to 0). The processing returns to step S102 where further record data exists or not is determined. If the record data exists, the processing moves to step S103 where a recording operation for the next line is performed.

On the other hand, if it is determined in step S104 that the count value is not higher than the first threshold value, the processing returns to step S102 where further record data exists or not is determined. If the record data exists, the processing moves to step S103 where a recording operation for the next line is performed. Subsequently, the processing in steps S104 to S107 is repeated.

If it is determined in step S102 that no further record data exists, that is, if recording for one page completes, the processing moves to step S108 where the recording medium is discharged. Then, processing after the discharge of the recording medium or after completion of the recording operation is performed.

In step S109, whether the wiping-while-recording flag has an ON state or an OFF state is determined. If the wiping-while-recording flag has the ON state, the processing moves to step S110 where a wiping operation is executed. The wiping operation performs wiping four times (second wiping operation). When the wiping operation completes, the processing moves to step S111 where the wiping-while-recording flag is set to have the OFF state. In step S112, the count value is cleared. Then, this control ends.

According to this embodiment, the number of times of wiping of the wiping operation (first wiping operation) in step S105 is equal to one. In a case where a wiping operation has been executed before a recording operation completes, the wiping operation may reduce the throughput of the recording apparatus. Therefore, essentially, the wiping operation may be executed after a recording operation completes. However, a commercial recording apparatus for use in poster printing or CAD may have a wider recording surface for one page with a number of discharges which may cause defective discharge during a recording operation. In such a case, the recovery processing involving a wiping operation is to be performed before the recording operation completes.

According to this embodiment, the wiping operation before a recording operation completes performs wiping once that is a minimum so that the reduction of the throughput can be minimized. On the other hand, because the minimum processing is performed for ink stains on the discharge opening surface of the record head before a recording operation completes, the ink stains may not be sufficiently removed. The ink stains adhered to the discharge opening surface occur immediately after ink is discharged. Therefore, the ink droplets still have a liquid state. The ink droplets having a liquid state can be relatively easily removed by the wiping operation, and slight ink stains adhered on the discharge opening surface may have a little influence on the discharging. Therefore, it can be considered that the wiping operation to be performed before a recording operation completes can be the minimum processing.

On the other hand, leaving ink droplets adhered to the discharge opening surface as they changes the ink droplets from a liquid state to a solid state, and the ink droplets are stuck to the discharge opening surface. The stuck ink stains cannot be easily removed by the wiping operation and may be left to clog the discharge opening surface and cause defective discharge. Accordingly, in order to securely remove ink stains adhered to the discharge opening surface after a recording operation completes, a stronger wiping operation (with higher wiping performance) than the wiping operation executed before the completion of the recording operation is to be executed. According to this embodiment, as the stronger wiping operation, wiping is performed a plurality of number of times (four times in this embodiment). Performing the wiping a plurality of number of times after completion of a recording operation can securely remove ink stains that cannot be removed sufficiently by wiping once, keeping a satisfactory state of the discharge opening surface of the record head.

Referring back to the flowchart in FIG. 7, if it is determined in step S109 that the wiping-while-recording flag has an OFF state, the processing moves to step S113. In step S113, the count value and a second threshold value are compared. According to this embodiment, the second threshold value is $1\times10^9$. If the count value is higher than the second threshold value, the processing moves to step S114 where a wiping operation is executed which performs wiping four times (second wiping operation). When the wiping operation completes, the processing moves to step S115 where the count value is cleared.

In this way, without execution of the wiping operation before a recording operation completes, a stronger wiping operation can be executed after the recording operation completes if the count value is higher than the second threshold value to keep a satisfactory state of the discharge opening surface of the record head. Here, the second threshold value is lower than the first threshold value. This setting can facilitate the execution of the wiping operation after, rather than before, a recording operation completes. Thus, reduction of the throughput due to the execution of the wiping operation before completion of the recording operation can be minimized as much as possible, and, at the same time, a satisfactory state of the discharge opening surface of the record head can be kept after the recording operation completes.

On the other hand, if the count value is not higher than the second threshold value in step S113, it is determined that the discharge opening surface of the record head has a satisfactory state. Then, the control ends without execution of a wiping operation.

Under the control according to this embodiment, in a case where the count value is higher than the first threshold value during a recording operation, a minimum wiping operation is performed before the recording operation completes, and, if the wiping operation has been performed, a stronger wiping operation is performed after the recording operation completes. If the wiping operation has not been performed and if the count value is higher than the second threshold value lower than the first threshold value, a stronger wiping operation is performed after the recording operation completes. Thus, the reduction of the throughput can be suppressed, and, at the same time, a satisfactory state of the discharge opening surface of the record head can be kept.

Second Embodiment

Next, a second embodiment of the present disclosure will be described with reference to drawings. Any repetitive description on the similar configuration to that of the first embodiment will be omitted.

According to the first embodiment, in a case where a minimum wiping operation has been performed before a recording operation completes, a stronger wiping operation is performed after the recording operation completes. According to the second embodiment, the wiping operation to be performed after a recording operation completes can be optimized based on a count value.

Figure 8:
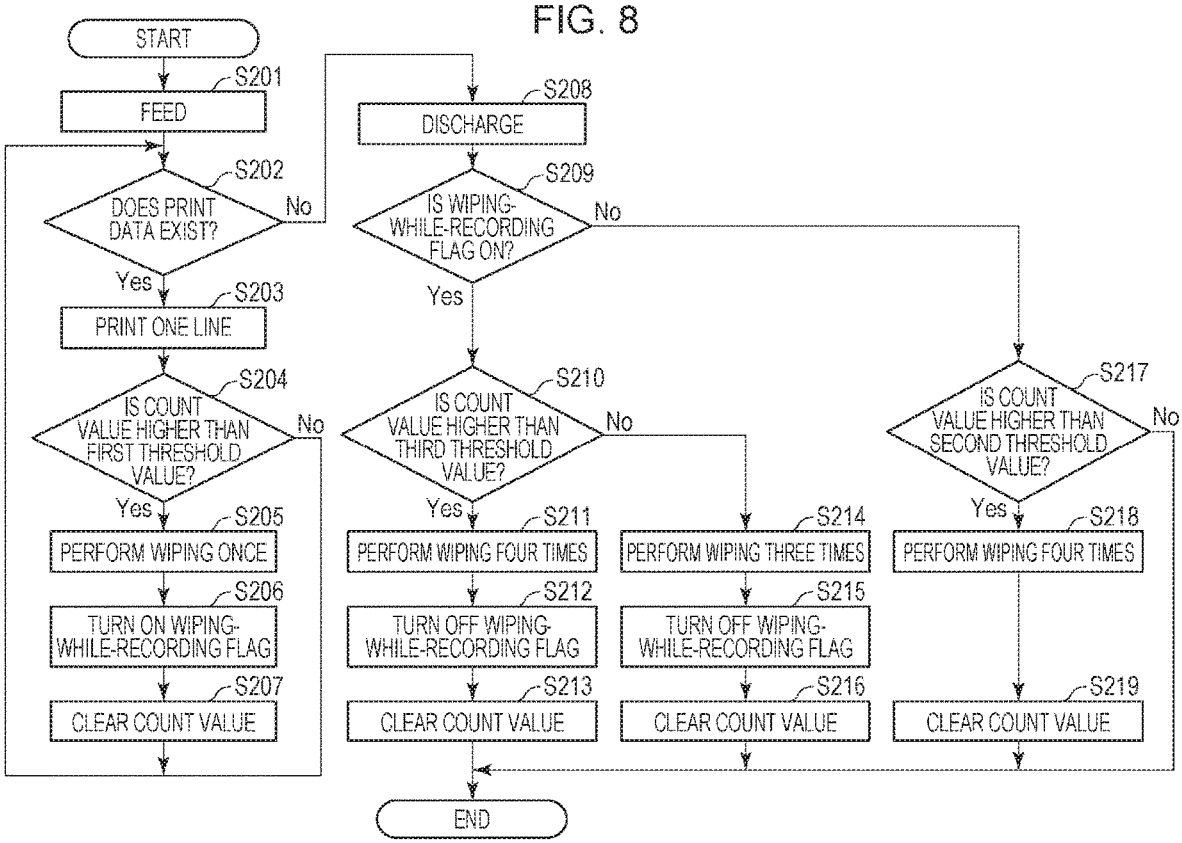
FIG. 8 is a flowchart illustrating control steps to be performed on a recovery operation according to a second embodiment.

Control steps for recovery operations to be performed for keeping satisfactory discharge performance of a record head according to this embodiment will be described with reference to a flowchart in FIG. 8.

Because processing in steps S201 to S208 is the same as the processing in steps S101 to S108 in FIG. 7 according to the first embodiment, any repetitive description will be omitted. Processing will be described which is to be performed after a recording medium P is discharged in step S208, that is, after a recording operation completes.

If the recording medium P is discharged in step S208, the processing moves to step S209 where whether the wiping-while-recording flag has an ON state or an OFF state is determined. If the wiping-while-recording flag has an ON state, the processing moves to step S210.

In step S210, the count value is compared with a third threshold value. According to this embodiment, the third threshold value is $0.5\times10^9$. Here, the third threshold value is lower than the second threshold value. If the count value is higher than the third threshold value, the processing moves to step S211 where a wiping operation is executed which performs wiping four times (second wiping operation). When the wiping operation completes, the processing moves to step S212 where the wiping-while-recording flag is set to have an OFF state. Then the count value is cleared in step S213, and the control ends.

On the other hand, it the count value is not higher than the third threshold value in step S210, the processing moves to step S214 where a wiping operation is executed which performs wiping three times (third wiping operation). When the wiping operation completes, the processing moves to step S215 where the wiping-while-recording flag is set to have an OFF state. Then, the count value is cleared in step S216, and the control ends.

If the wiping-while-recording flag has the OFF state in step S209, the processing moves to step S217. Because processing in steps S217 to S219 is the same as the processing in steps S113 to S115 in FIG. 7 according to the first embodiment, any repetitive description will be omitted.

According to this embodiment, after a recording operation completes, the count value and the third threshold value are compared in step S210. If the count value is higher than the third threshold value, a wiping operation is executed which performs wiping four times (second wiping operation). On the other hand, if the count value is not higher than the third threshold value, a wiping operation is executed which performs wiping three times (third wiping operation). The count value not higher than the third threshold value indicates that a lower ink discharge amount after the wiping operation (first wiping operation) is executed while a recording operation is being performed. Therefore, it can be predicted that a lower amount of ink is adhered to the discharge opening surface of the record head. Therefore, if the count value is not higher than the third threshold value after the recording operation, wiping can be performed three times, as a reduced number of times, instead of four times to keep a satisfactory state of the discharge opening surface of the record head after the recording operation completes. The reduction of the number of times of wiping (or a wiping operation with lower wiping performance than that of the second wiping operation) can increase the lives of the record head and the wipers, contributing to improved usability to a user.

The control according to this embodiment can suppress reduction of the throughput and can keep a satisfactory state of the discharge opening surface of the record head as well as an increased life of the recording apparatus which contributes to improved usability to a user.

Third Embodiment

Next, a third embodiment of the present disclosure will be described with reference to drawings. Any repetitive description on the similar configurations to that of the aforementioned embodiments will be omitted.

According to the aforementioned embodiments, one count value is used, and the count value is compared with the first threshold value and the second threshold value to determine the necessity of execution of a wiping operation. According to this embodiment, two count values (first count value and second count value) are used and are corrected with different correction coefficients for counting. Based on the corrected count values, the necessity for execution of a wiping operation is determined.

Figure 9:
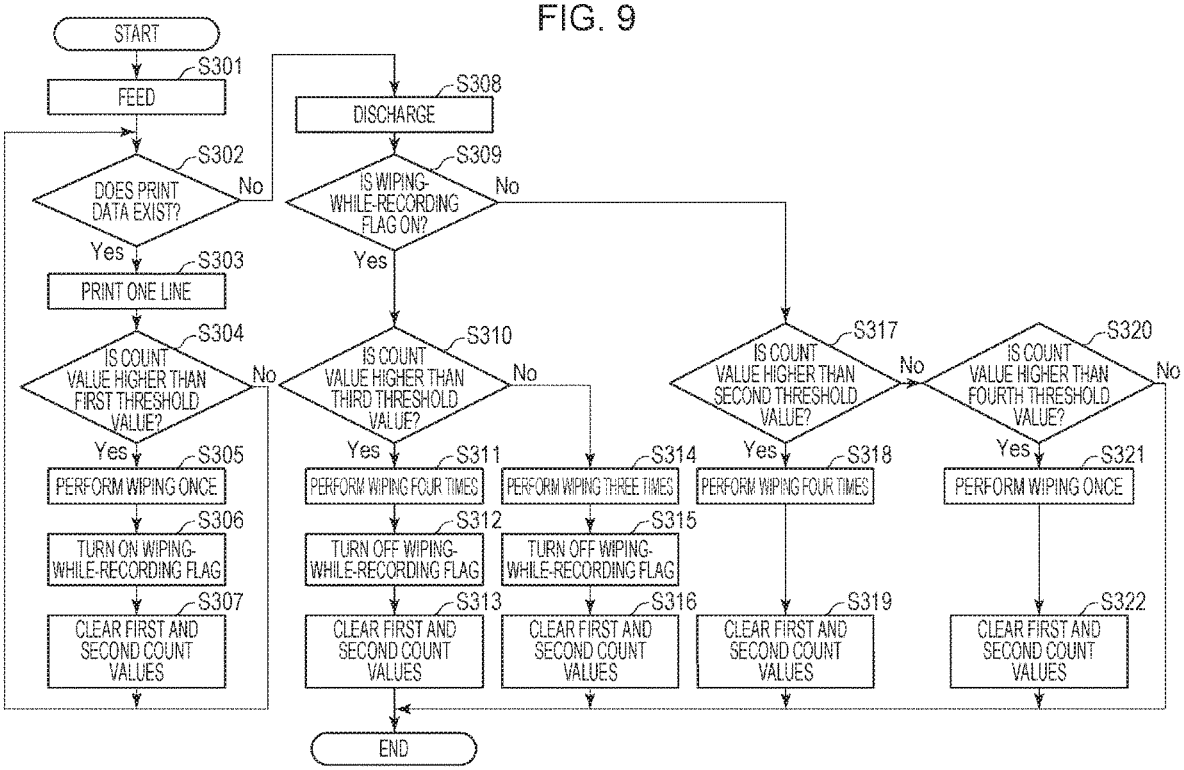
FIG. 9 is a flowchart illustrating control steps to be performed on a recovery operation according to a third embodiment.

Control steps for recovery operations to be performed for keeping satisfactory discharge performance of a record head according to this embodiment will be described with reference to a flowchart in FIG. 9.

In step S301, in response to a record command, a recording medium P is fed and is conveyed to a position (record start position) where recording with the record head is started. Next in step S302, whether record data generated by the conversion processing exists or not is determined. If the record data exists, the processing moves to step S303 where a recording operation for one line (one line feed or one band) is performed. Here, the number of dots of ink (amount of ink) discharged from the record head in the recording operation is counted as a first dot count value and a second dot count value.

Then, the dot count values are corrected by using correction coefficients with respect to the number of discharges N per unit time period (predetermined time period) illustrated in FIG. 10. More specifically, with respect to the number of discharges N per unit time period, a first correction coefficient and a second correction coefficient on a table in FIG. 10 are referred. The first dot count value is corrected by being multiplied by the first correction coefficient while the second dot count value is corrected by being multiplied by the second correction coefficient. Then, the corrected first count value and second count value are added, and the resulting value is stored in the EEPROM 122. The calculation method will be described in detail below.

Next in step S304, the first count value is compared with a first threshold value. According to this embodiment, the first threshold value is $2\times10^9$. If the first count value is higher than the first threshold value, the processing moves to step S305 where a wiping operation is executed which performs wiping once (first wiping operation). Next, in step S306, the wiping-while-recording flag is set to have an ON state. In step S307, the first count value and the second count value are cleared. Retuning to step S302, whether further record data exists or not is determined. If record data exists, the processing moves to step S303 where a recording operation for the next line is performed.

On the other hand, if it is determined in step S304 that the first count value is not higher than the first threshold value, the processing returns to step S302 where further record data exists or not is determined. If the record data exists, the processing moves to step S303 where a recording operation for the next line is performed. Subsequently, the processing in steps S304 to S307 is repeated.

If it is determined in step S302 that no further record data exists, that is, if recording for one page completes, the processing moves to step S308 where the recording medium is discharged. Then, processing after the discharge of the recording medium or after completion of the recording operation is performed.

In step S309, whether the wiping-while-recording flag has an ON state or an OFF state is determined. If the wiping-while-recording flag has the ON state, the processing moves to step S310.

In step S310, the first count value and a third threshold value are compared. According to this embodiment, the third threshold value is equal to $0.5\times10^9$. If the first count value is higher than the third threshold value, the processing moves to step S311 where a wiping operation is executed which performs wiping four times (second wiping operation). When the wiping operation completes, the processing moves to step S312 where the wiping-while-recording flag is set to have the OFF state. In step S313, the first count value and the second count value are cleared. Then, the control ends.

On the other hand, if the first count value is not higher than the third threshold value in step S310, the processing moves to step S314 where a wiping operation is executed which performs wiping three times (third wiping operation). When the wiping operation completes, the processing moves to step S315 where the wiping-while-recording flag is set to have the OFF state. In step S316, the first count value and the second count value are cleared. Then, the control ends.

On the other hand, if the wiping-while-recording flag has the OFF state in step S309, the processing moves to step S317. In step S317, the second count value and a second threshold value are compared. According to this embodiment, the second threshold value is equal to $1\times10^9$. If the second count value is higher than the second threshold value, the processing moves to step S318 where a wiping operation is executed which performs wiping four times (second wiping operation). When the wiping operation completes, the processing moves to step S319 where the first count value and the second count value are cleared.

On the other hand, if the second count value is not higher than the third threshold value in step S317, the processing moves to step S320. In step S320, the second count value and a fourth threshold value are compared. According to this embodiment, the fourth threshold value is equal to $0.1\times10^9$. Here, the fourth threshold value is lower than the second threshold value. If the second count value is higher than the fourth threshold value, the processing moves to step S321 where a wiping operation is executed which performs wiping once (fourth wiping operation). When the wiping operation completes, the processing moves to step S322 where the first count value and the second count value are cleared. On the other hand, if the second count value is not higher than the fourth threshold value in step S320, the control ends without executing a wiping operation.

According to this embodiment, in a case where no wiping operation has been executed before completion of a recording operation, a plurality of threshold values such as the second threshold value and the fourth threshold value are provided for determining whether a wiping operation is to be executed after completion of the recording operation or not. Thus, the wiping operation after completion of a recording operation can be optimized based on a count value or count values.

According to this embodiment, two threshold values of the second threshold value and the fourth threshold value are provided for determining whether a wiping operation is to be performed after completion of a recording operation or not. However, more threshold values may be provided instead.

According to this embodiment, the table in FIG. 10 illustrates that the correction coefficient value decreases as the number of discharges (dot counts) N per unit time period (predetermined time period) decreases and that the correction coefficient value increases as the number of discharges (dot counts) N per unit time period (predetermined time period) increases. This means that the correction coefficient value in a case where the dot count per unit time period is higher than a predetermined number is higher than the correction coefficient value in a case where the dot count per unit time period is lower than the predetermined number. This is because the ink adherent amount to the discharge opening surface of the record head decreases as the number of discharges N per unit time period decreases and the ink adherent amount to the discharge opening surface of the record head increases as the number of discharges N per unit time period increases.

Here, the unit time period may be a minimum value that is settable by the CPU 101. For example, in a case where the number of discharges N is to be calculated for each recording operation for one line feed, it is difficult to discriminate between an image locally having an intensive number of discharges and an image having an average number of discharges for one line feed. This may reduce the accuracy for estimating the ink adherent amount to the discharge opening surface of the record head. Accordingly, the number of discharges per unit time period can be corrected to execute a wiping operation at an optimum time.

Examples of the calculation will be specifically described below. For example, it is assumed here that the unit time period is 0.01 sec, and the number of discharges N in the first unit time period is equal to 100,000. With reference to FIG. 10, the first count value is corrected to 100,000×0.6=60,000, and the second count value is corrected to 100,000×0.9=90,000. Assuming that the number of discharges N in the next unit time period is equal to 50,000, the first count value is corrected to 50,000×0.4=20,000, and the second count value is corrected to 50,000×0.6=30,000. Assuming that a recording operation for one line feed takes one second, the correction as described above is performed every 0.01 sec. The sum value of the count values as a result of 100 corrections is stored in the EEPROM 122 as a corrected count value.

According to this embodiment, correction coefficients with different weighting values are set between the first count value and the second count value. The first count value is to be compared with the first threshold value before a recording operation completes to determine the necessity of execution of a wiping operation. The second count value is to be compared with the second threshold value after a recording operation completes to determine the necessity for execution of a wiping operation. Therefore, the value of the correction coefficient for the second count value can be equal to or higher than the value of the correction coefficient for the first count value so that a wiping operation can be more easily executed after a recording operation completes than before a recording operation completes. The second threshold value can also be set to be lower than the first threshold value so that a wiping operation can be more easily executed after a recording operation completes than before a recording operation completes. Thus, reduction of the throughput due to execution of the wiping operation before completion of the recording operation can be minimized as much as possible, and, at the same time, a satisfactory state of the discharge opening surface of the record head can be kept after the recording operation completes.

The control according to this embodiment can suppress reduction of the throughput and can keep a satisfactory state of the discharge opening surface of the record head as well as an increased life of the recording apparatus which contributes to improved usability to a user.

Other Embodiments

According to the aforementioned embodiments, the first wiping operation to be executed before a recording operation completes performs wiping once. The stronger second wiping operation than the first wiping operation to be executed after the recording operation completes performs wiping four times.

However, other forms of operations may be adopted as the first wiping operation and the second wiping operation. For example, both of the first wiping operation and the second wiping operation may perform wiping once, and the movement speed (wiping speed) of wipers in the second wiping operation may be lower than the movement speed (wiping speed) of the wipers in the first wiping operation. The lower wiping speed can increase the effect for removing ink adherent to the discharge opening surface by the wipers. The lower wiping speed, however, increases the time for the recovery operation.

Accordingly, the first wiping operation can be executed at a higher wiping speed before completion of a recording operation so that reduction of the throughput can be minimized as much as possible. Then, the second wiping operation can be performed at a lower wiping speed than that of the first wiping operation after completion of the recording operation to keep a satisfactory state of the discharge opening surface of the record head after the completion of the recording operation.

The recovery unit can be configured to be capable of moving vertically to adjust the distance between the discharge opening surface of the record head and the wipers so that the strength of the wiping operations can be adjusted. Because a reduced distance between the discharge opening surface and the wipers increases contact pressure of the wipers against the record head, the wiping operation can remove more ink adherent. On the other hand a reduced distance between the discharge opening surface and the recovery unit may possibly cause ink stains to be adhered to the discharge opening surface of the record head due to a splash of ink when an auxiliary discharge is performed toward the caps before and after and in the middle of a recording operation. Accordingly, in general, a predetermined distance is kept between the discharge opening surface and the wipers, and the distance between the discharge opening surface and the wipers can be reduced only for performing a wiping operation. However, the distance adjustment may take time.

Accordingly, the first wiping operation before completion of a recording operation can be performed with a predetermined distance kept between the discharge opening surface and the wipers to minimize reduction of the throughput as much as possible. Then, the second wiping operation after completion of the recording operation can be executed with a distance adjusted to be shorter than that for the first wiping operation between the discharge opening surface and the wipers. This can keep a satisfactory state of the discharge opening surface of the record head after the recording operation completes.

According to the aforementioned embodiments, a count value or values and a threshold value or values are compared to determine the necessity for execution of a wiping operation. However, the threshold value or values can be varied based on the environment temperature, the environment humidity, and the type of ink, for example. The count value or values can also be corrected based on the environment temperature, the environment humidity, and the type of ink, for example.

Although the dot count value or values are corrected with correction coefficient or coefficients based on a dot count per unit time period according to the aforementioned embodiments, it or they may be corrected based on any other set value or values. For example, in a case where a recording medium that is easy to warp such as thin paper is used, the distance between the recording medium and the record head is to be increased. However, an increased distance between the recording medium and the record head also increases the ink adherent amount depending on the discharge amount to the discharge opening surface of the record head. Accordingly, the value of the correction coefficient can be varied in accordance with the set value for the distance between the recording medium and the record head or with the record mode.

According to the aforementioned embodiments, a so-called serial type inkjet recording apparatus has been described wherein, when an intermittently conveyed recording medium stops, the carriage is moved to discharge ink from the record head for recording an image. However, the present disclosure is also applicable to a line-type inkjet recording apparatus including a line-type record head capable of discharging ink across a range corresponding to an entire width of a serially conveyed recording medium.

According to the present disclosure, an inkjet recording apparatus can be provided which can suppress reduction of its throughput and, at the same time, can keep a satisfactory state of a discharge opening surface of a record head thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-123451 filed Jun. 23, 2017, which is hereby incorporated by reference herein in its entirety.

What is claimed is:

1. An inkjet recording apparatus comprising:

a record head having a discharge opening surface provided with discharge openings for discharging ink;

a carriage configured to move with the record head mounted thereon;

a conveyance unit configured to convey a recording medium;

a control unit configured to perform a recording operation for recording on the recording medium by repeating a conveyance operation for conveying the recording medium by the conveyance unit and an image forming operation for forming an image by discharging ink from the record head while moving the carriage;

a wiping unit configured to perform a wiping operation for wiping the discharge opening surface;

a count unit configured to count dots of ink discharged from the record head after a previous wiping operation is performed; and wherein the control unit causes the wiping unit to execute a first wiping operation during recording on one sheet of the recording medium where the count value counted by the count unit is higher than a first threshold value, causes the wiping unit to execute a second wiping operation in a case where the count value counted by the count unit is higher than a second threshold value, which is lower than the first threshold value when the recording for recording on the recording medium completes, and does not cause the wiping unit to execute the second wiping operation in a case where the count value is lower than the second threshold value when the recording for recording on the recording medium completes, and in a case where the first wiping operation is executed during recording on the recording medium, the control unit causes the wiping unit to execute the second wiping operation even if the count value is lower than the second threshold value when the recording operation for recording on the recording medium completes.

2. The inkjet recording apparatus according to claim 1, wherein the second wiping operation has a higher wiping performance than that of the first wiping operation.

3. The inkjet recording apparatus according to claim 1, wherein the count unit has a first dot counting unit and a second dot counting unit configured to count dots of ink discharged from the record head after the previous wiping operation is performed, wherein, in a case where a first value calculated based on the dots counted by the first dot counting unit is higher than the first threshold value during recording on the recording on the medium, the control unit causes the wiping unit to execute the first wiping operation before the recording on the recording medium completes and, in a case where a second value calculated based on the dots counted by the second dot counting unit is higher than the second threshold value when the recording on the recording medium completes, the control unit causes the wiping unit to execute the second wiping operation.

4. The inkjet recording apparatus according to claim 3, wherein the first value is acquired by adding values each acquired by multiplying a dot count for a predetermined time period counted by the first dot counting unit by a first correction coefficient based on the dot count for the predetermined time period, and wherein the second value is acquired by adding values each acquired by multiplying a dot count for a predetermined time period counted by the second dot counting unit by a second correction coefficient based on the dot count for the predetermined time period.

5. The inkjet recording apparatus according to claim 4, wherein a value of the first correction coefficient in a case where the dot count for the predetermined time period is higher than a first predetermined number is higher than a value of the first correction coefficient in a case where the dot count for the predetermined time period is lower than the first predetermined number, and wherein a value of the second correction coefficient in a case where the dot count for the predetermined time period is higher than a second predetermined number is higher than a value of the second correction coefficient in a case where the dot count for the predetermined time period is lower than the second predetermined number.

6. The inkjet recording apparatus according to claim 4, wherein a value of the second correction coefficient for the dot count for the predetermined time period is equal to or higher than a value of the first correction coefficient for the dot count for the predetermined time period.

7. The inkjet recording apparatus according to claim 3, wherein, in a case where the first wiping operation has been performed and the first value is higher than a third threshold value being lower than the first threshold value when the recording on the recording medium completes, the control unit executes the second wiping operation and, in a case where the first value is not higher than the third threshold value, the control unit executes a third wiping operation having a lower wiping performance than that of the second wiping operation.

8. The inkjet recording apparatus according to claim 3, wherein, in a case where the first wiping operation is not executed and where the second value is higher than the second threshold value when the recording on the recording medium completes, the control unit executes the second wiping operation and, in a case where the second value is not higher than the second threshold value and is higher than a fourth threshold value being lower than the second threshold value, the control unit executes a fourth wiping operation having a lower wiping performance than that of the second wiping operation.

9. The inkjet recording apparatus according to claim 8, wherein the fourth wiping operation performs wiping a lower number of times than that of the second wiping operation.

10. The inkjet recording apparatus according to claim 1, wherein the second wiping operation performs wiping a higher number of times than that of the first wiping operation.

11. The inkjet recording apparatus according to claim 10, wherein the first wiping operation performs wiping once on the discharge opening surface, and wherein the second wiping operation performs wiping a plurality of number of times on the discharge opening surface.

12. An inkjet recording apparatus comprising:

a record head having a discharge opening surface provided with discharge opening for discharging ink;

a carriage configured to move with the record head mounted thereon;

a conveyance unit configured to convey a recording medium;

a control unit configured to perform a recording operation for recording on the recording medium by repeating a conveyance operation for conveying the recording medium by the conveyance unit and an image forming operation for forming an image by discharging ink from the cord head while moving the carriage;

a wiping unit configured to perform a wiping operation for wiping the discharge opening surface;

a count unit configured to count dots of inks discharged from the record head after a previous wiping operation is performed; and wherein the control unit causes the wiping unit to execute a first wiping operation during recording on one sheet of the recording medium in a case where the count value counted by the count unit is higher than a first threshold value, causes the wiping unit to execute a second wiping operation in a case where the count value counted by the count unit is higher than a second threshold which is lower than the first threshold value when the recording operation for recording on the recording medium completes, in a case where the first wiping operation has been executed and where the count value counted by the count unit is higher than a third threshold value which is lower than the second threshold value when the recording operation on the one sheet of the recording medium completes, the control unit causes the wiping to execute the second wiping operation, and in a case where the count value is not higher than the third threshold value, the control unit causes the wiping unit to execute a third wiping operation having a lower wiping performance than that of the second wiping operation.

13. The inkjet recording apparatus according to claim 12, wherein the third wiping operation performs wiping a lower number of times than that of the second wiping operation.

* * * * *